US006170118B1

(12) United States Patent
McIntyre et al.

(10) Patent No.: US 6,170,118 B1
(45) Date of Patent: Jan. 9, 2001

(54) COLLECTION APPARATUS FOR USE WITH BLOWER/VACUUM UNITS

(75) Inventors: Paul Curtis McIntyre; Michael A. Robinson, both of Charlotte, NC (US)

(73) Assignee: Upkeeper Corporation, Charlotte, NC (US)

( * ) Notice: Under 35 U.S.C. 154(b), the term of this patent shall be extended for 0 days.

(21) Appl. No.: 08/953,847

(22) Filed: Oct. 15, 1997

(51) Int. Cl.[7] ..... A47L 9/12

(52) U.S. Cl. ..... 15/327.6; 15/327.1; 15/323; 55/DIG. 3

(58) Field of Search ..... 15/327.1, 327.6, 15/323; 55/DIG. 3

(56) References Cited

U.S. PATENT DOCUMENTS

| | | | | |
|---|---|---|---|---|
| 1,328,458 | | 1/1920 | Schiek | 248/129 |
| 3,082,465 | | 3/1963 | Wood | 15/327.1 |
| 3,193,847 | | 7/1965 | Mashura | 52/169.1 |
| 3,570,222 | | 3/1971 | Dudek et al. | 55/472 |
| 3,740,933 | * | 6/1973 | Hollowell | 15/327.6 |
| 3,957,327 | | 5/1976 | Parrish | 312/284 |
| 4,072,483 | | 2/1978 | Doyle | 55/372 |
| 4,105,420 | | 8/1978 | Moore | 96/416 |
| 4,222,753 | | 9/1980 | Mills | 96/415 |
| 4,467,494 | | 8/1984 | Jones | 15/353 |
| 4,569,100 | | 2/1986 | Purkapile | 15/327.2 |
| 4,654,926 | * | 4/1987 | McCambridge | 15/327.6 |
| 4,715,872 | | 12/1987 | Snyder | 55/315 |
| 4,799,699 | | 1/1989 | Berfield et al. | 280/79.5 |
| 4,888,849 | | 12/1989 | Hult et al. | 15/327.2 |
| 4,894,881 | | 1/1990 | Palmer et al. | 15/328 |
| 4,993,107 | | 2/1991 | Zoni | 210/224 |
| 5,052,570 | | 10/1991 | Johansen | 220/4.33 |
| 5,069,696 | | 12/1991 | Bruno, III | 55/476 |
| 5,209,367 | | 5/1993 | Van Musscher et al. | 220/401 |
| 5,242,588 | | 9/1993 | Reese | 210/232 |
| 5,259,087 | | 11/1993 | Loveless et al. | 15/327.6 |
| 5,404,614 | * | 4/1995 | Stephens | 15/327.6 |
| 5,455,983 | | 10/1995 | Crouser et al. | 15/331 |
| 5,515,573 | * | 5/1996 | Frey | 15/327.6 |
| 5,528,794 | | 6/1996 | Tomasiak | 15/323 |
| 5,564,155 | | 10/1996 | Monesson | 15/246.2 |
| 5,606,769 | | 3/1997 | Tomasiak et al. | 15/327.6 |

OTHER PUBLICATIONS

PCT International Search Report mailed Jun. 3, 1999 in PCT/US98/21756.

* cited by examiner

*Primary Examiner*—Robert J. Warden, Sr.
*Assistant Examiner*—Theresa T. Snider
(74) *Attorney, Agent, or Firm*—Charles W. Calkins; Kilpatrick Stockton LLP

(57) ABSTRACT

A mobile, lightweight, universal collection apparatus for use with blower/vacuum units for quickly and easily collecting and storing large amounts of bulky debris or materials which is readily disassembled for conveniently storing and shipping the apparatus. The collection apparatus includes a large container, a removable lid, a disposable or reusable liner, an intake hose attachment and a base with rollers for movably supporting the container. The preferred container is comprised of one or more transparent, flat panels adapted to be readily secured together to form a cylindrical-shaped container for holding large amounts of debris or materials. The removable lid is transparent and is mounted on the container and includes a power unit connection for attaching the blower/vacuum unit, an inlet connection for attaching various intake hose attachments and an integral filter. The power unit connection and inlet connection are universally adapted to be connected to different power units and to different accessories, respectively. In use, debris is drawn into the inlet connection through the intake hose attachment by a blower/vacuum unit and deposited in the liner within the container. The collection apparatus also includes a mobile base for supporting the container and easily maneuvering the container over a large area. The base may include a platform for carrying a gasoline or propane powered generator and a storage component for storing various attachments and extra liners for the container.

40 Claims, 10 Drawing Sheets

COLLECTION APPARATUS FOR USE WITH BLOWER/VACUUM UNITS

BACKGROUND OF INVENTION

1. Field of Invention

The subject invention is generally related to devices for collecting and storing material and debris in an industrial, commercial or residential setting and is specifically directed to a mobile collection system for use with vacuum and blower units for quickly and easily collecting and storing large volumes of bulk material and debris as it is collected.

2. Description of the Prior Art

Various types of industrial vacuum machines have been used for many years for the purpose of collecting material and cleaning particulate debris in industrial, commercial and residential locations. Heavy-duty vacuum machines with large collection capacities are essential to cleaning, collecting material and maintaining factories, parks, amusement parks, shopping centers, lumber yards, construction sites, hotels, convention halls, and other industrial and commercial locations. This is due not only to the fact that such sites often contain a great volume of discarded or unwanted particulate matter, but also because of the fact that in an industrial setting, the unwanted debris tends to be found in a great variety of shapes, sizes and constituent materials. In addition, various industrial and commercial operations often generate large volumes of material, which may be desirable to re-use or recycle.

Typical industrial vacuum cleaners which include an upright metal canister connected to a vacuum pump are disclosed in U.S. Pat. Nos. 4,723,971 and 4,467,494. One disadvantage of this type of industrial vacuum cleaner is its large, bulky design. Vacuum cleaners of such a design are comparatively heavy due to the metal cylinder which forms the receptacle for the debris. Due to their bulk and weight, vacuum machines of such design may also be difficult to maneuver over large areas such as factory floors, worksites and amusement parks. Further, vacuum machines of this type use suction (water-lift) to clean, typically have only 60–80 CFM of air flow, and typically utilize a maximum two inch diameter intake hose which limits the size of bulk debris collected. Also, there is a loss of power when the vacuum intake is extended beyond a few feet of the unit.

Another disadvantage of this type of vacuum machine is that the metal canister which forms the receptacle for the debris is not designed to accommodate large volumes of bulky debris. Additional examples of vacuum machines with similar metal canister forming the receptacle for the debris are shown in U.S. Pat. No. 3,570,222 issued Mar. 16, 1971 to Dudek et al.; U.S. Pat. No. 4,072,483 issued Feb. 7, 1978 to Doyle, Jr.; U.S. Pat. No. 5,069,696 issued Dec. 3, 1991 to Bruno, III; U.S. Pat. No. 5,242,588 issued Sep. 7, 1993 to Reese; and U.S. Pat. No. 5,259,087 issued Nov. 9, 1993 to Loveless et al.

An example of a mobile and portable industrial vacuum cleaner system ideal for the collection of bulky debris, such as empty aluminum cans, plastic pellets, packing peanuts, fabric, paper, carpet clippings, popcorn, real peanuts, drink cups and straws, is the UPKEEPER VOYAGER TURBO TRANSFORMER (R) vacuum machine, as shown in U.S. Pat. No. 5,722,110, manufactured by Upkeeper Corporation, the assignee of the subject application. Unlike prior art vacuum machines which utilize water-lift to clean, the turbo fan technology used in the Upkeeper vacuum machine generates 500 CFM of air flow to clean debris with ease and the air flow works, even at distances of 20–25 feet overhead.

While the Upkeeper vacuum has greatly advanced the art relating to industrial vacuums, it is designed to include a debris receptacle or collection bag which may not be readily suitable for storing extra large volumes of debris. When the bag is full, the operator must turn off the vacuum power and empty the bag before continuing to collect debris. Thus, the clean up process is slowed. While there are prior art vacuum machines designed to provide large receptacles for storing large volumes of debris as it is collected, the prior art machines are awkward, heavy and require a large space for storage of the machine.

In addition, prior art vacuums using 60–80 inches of water lift (suction) must have a storage receptacle constructed of a sturdy heavy material such as metal, which require large areas for storage. Without such a sturdy, heavy material, the storage receptacle would implode (collapse) with the 60–80 inches of water lift generated. Thus, prior art storage receptacles have not been constructed from lightweight materials. Further, these prior art vacuums must be constructed so as to maintain a virtual airtight seal since they rely heavily on the 60–80 inches of water for cleaning. Also, the prior art vacuum machines are not capable of collecting large bulk debris, such as cans, cups, large scraps of cloth, leather, canvas, plastic, pine cones, leaves and the like.

Therefore, there is a need for a maneuverable lightweight, thin walled, transparent apparatus for use with a heavy duty vacuum machine for easily and quickly collecting and storing large volumes of bulky debris as the debris is collected to reduce time needed for clean up.

SUMMARY OF THE INVENTION

The subject invention is directed to a mobile, lightweight, universal collection apparatus or drum kit for use with blower/vacuum units for quickly and easily collecting and storing large amounts of bulky debris, leaves or other lightweight items, yet is readily disassembled for conveniently storing and shipping the apparatus. The collection apparatus is specifically designed to include a universal attachment accessory to permit easy and secure attachment of either a blower/vacuum unit and intake hose attachments with large diameter intake capacity for picking up large debris or other items while providing a large mobile receptacle for storage of the debris as it is collected by the unit. In use, the subject invention provides a system which utilizes a blower/vacuum unit to clean up large volumes of bulky debris while simultaneously depositing the debris into a large, lightweight, storage container. It is a feature of the subject invention that the system is versatile and may utilize a collapsible, transparent, storage container or a standard 55-gallon drum. Thus, the subject invention provides a quick, easy and economical collection system which eliminates the hassle of frequently removing and emptying the vacuum collection bag when large amounts of debris are collected and eliminates the need for moving debris from a small container to a larger container.

In the preferred embodiment, the collection apparatus includes a large transparent container or receptacle for debris, a transparent, removable lid, a transparent, disposable liner, an intake hose attachment and a base with rollers or wheels for movably supporting the container. The removable lid includes an integral filter and may be designed to fit the open top of most containers selected by the user, preferably one having a large storage capacity. The lid also includes a power unit connection which may be universally adaptable to different blower/vacuum units for removably mounting such unit on the lid. In addition, the lid includes an inlet connection which is universally adaptable to fit different accessories for removably attaching a variety of intake hose attachments, having a large diameter intake capability, to the lid. In use, debris is drawn into the inlet connection of the container through the intake hose attachment by the blower/vacuum unit and deposited into the internal liner within the container. The inclusion of the inlet connection in the lid for collecting material and debris permits the material and debris to be drawn directly into the container thus bypassing the blower/vacuum unit. By bypassing the blower/vacuum unit, debris does not enter or travel through the impeller of the unit. As a result, the blower/vacuum unit operates more quietly, saves wear and tear on the impeller and does not shred or disintegrate the debris and materials collected, such as, cloth, leather, packaging materials, styrofoam, foam rubber, plastics, aluminum beverage cans and plastic balls, which may then be further processed, reused or recycled. The operator may easily roll the container to desired locations for picking up debris. Because the subject invention provides a large collection receptacle, large amounts of debris may be collected and stored therein without the need for frequent interruptions to empty the container. When the container is full, the removable lid is simply removed and the liner containing the debris is easily lifted from the container and disposed by the operator.

In the preferred embodiment, the debris receptacle or container is uniquely comprised of one or more substantially flat, transparent sheets or panels which may be readily assembled and disassembled. The panels are formed of a sturdy, lightweight, semi-flexible plastic or metal sheets and designed to be secured to one another and assembled to form a cylindrical-shaped container including an open top and an open bottom which is supported and closed by the base. In the preferred embodiment, the plastic panels and liner are transparent for permitting the operator to easily monitor the remaining capacity of the container or collapsible barrel while it is in use and the barrel is being filled with debris. The cylindrically formed container is approximately the size of a 55 gallon barrel. In the preferred embodiment, the panels of the collapsible barrel are formed or molded transparent plastic sheets which interlock with one another using no hardware to form the cylindrical container. In another embodiment, the panels are assembled into the collapsible barrel using pop rivets, washers, screws, nuts and/or push-through fasteners which penetrate the panel edges and secure the panels together to form a cylindrically shaped container. Alternatively, the panels may be assembled into a collapsible barrel by attaching a plastic or metal connector strip to the panel edges. The collapsible barrel may also employ a top and bottom sponge or rubber type air seal, which is fitted onto the rim of each end.

It is a feature of the subject invention that the container is designed to accommodate large volumes of debris while being readily disassembled into flat panels for convenient storage and shipment of the container. Heretofore, none of prior art vacuum units utilize collapsible or cardboard containers. Further, a collapsible container is not suitable for a typical vacuum unit because typical vacuum units utilize suction (water-lift) and operate with high static pressure which will typically collapse a lightweight, thin-walled, multi-piece barrel. Thus, a more substantial, non-collapsible barrel has been previously required for use with such vacuum units. In the preferred embodiment of the invention, a vacuum unit which operates under low static pressure, and further described below, is utilized for eliminating the risk that the multi-piece container will collapse.

The preferred liner is disposable and includes a plurality of through holes near the top, open end of the bag to prevent the bag from collapsing while the vacuum unit is in use. The liner is designed to work with the multi-piece barrel construction of the preferred embodiment which includes an open bottom end (the bottom of the barrel is defined by the movable base) and thus, does not provide an airtight container. Also, the panels of the barrel do not join with a virtual airtight seal and allow for small air passageways between the joining sections of the barrel. While the presence of these air passageways accounts for a slight air flow loss through the intake hose on the inlet connection, there is not an appreciable amount of air flow loss to the extent that it diminishes the effectiveness of the unit's ability to collect debris. However, these small air passageways do generate enough air flow to overcome the structural integrity of the disposable, thin walled liner to cause the bag to collapse as the 500 cfm of air is drawn to the power head of the vacuum. Thus, liner is designed to include a plurality of through or vent holes near the top, open end of the liner allow the bag to "breathe". The vent holes provide an air path through which air entering through the air passageways can escape. In the preferred embodiment, the liner is a thin, transparent plastic disposable bag which is utilized under low static pressure and a high CFM condition. In the preferred liner, the vent holes are located in the top one-third of the bag while the bottom two-thirds of the bag is sealed for preventing leakage or spills as the bag is lifted and emptied. While the preferred container is collapsible, multi-piece drum, any large container may be used with the subject invention, including, but not limited to, a standard 55 gallon drum, a cardboard or plastic container and the like.

In the preferred embodiment, the lid is universally adaptable to securely fit the open top of most containers and preferably, the unique, collapsible container described and shown herein. The lid is molded of a transparent, lightweight, durable material, such as by way of example, a resilient plastic, and includes a top side and a bottom underside. The top side includes a raised portion and a power unit connection near the center of the raised portion. The power unit connection includes a coupling or attachment component which is universally adapted to be attached to different power units, such as a blower/vacuum unit, for picking up debris. The top side also includes an inlet connection designed to include a unique inlet adapter universally adapted to fit different intake hose accessories having a variety of hose sizes for carrying debris into the container. The bottom side of the lid includes an integral filter in the indented portion or depression formed in the underside of the lid by the raised portion on the top side. The filter is removably attached to the underside of the lid, such as with VELCRO (R), for easily and quickly removing and cleaning the filter and reattaching the same. The filter is positioned on the underside of the lid between the power unit connection and the interior of the container for filtering air drawn through the power unit connection by the blower/vacuum unit attached thereto. The filter serves as an air-cleansing medium to contain small air borne dust and dirt particulates from discharging freely into the atmosphere. The filter can be cleaned simply by detaching it from the Velcro (R) strips, without requiring the use of tools, and shaking it vigorously, using a compressed air hose or by rinsing it. In addition, a second collection bag, such as the universal collection bag which accompanies the Voyager Turbo (R) vacuum unit and most state of the art vacuum/blowers, can be fitted to the discharge chute for secondary filtration. The lid of the preferred embodiment may also include a foam stripping along the interior of the rim to provide an air seal between the lid and the container which increases air intake and cleaning efficiency at the collection point of the cleaning accessories. Alternatively, a sponge or rubber type air seal member may be fitted onto the top and bottom rims of the container to provide an air seal.

It is a feature of the subject invention that the lid is designed such that an existing electrically powered vacuum unit or a cordless, fuel powered unit, such as a leaf blower, may be mounted to the lid and utilized with the subject invention. Thus, the subject invention has a wide variety of applications, such as, it may be used by a homeowner with an existing leaf blower to quickly and easily collect and store leaves or in an industrial setting for cleaning up debris and depositing the debris into large storage containers as it is collected. Other applications for the subject invention are in commercial, retail and entertainment establishments which generate high volumes of pedestrian traffic resulting in the accumulation of gum, candy and food wrappings and cigarette packages. Other uses may be in carnivals and street festivals for the collection of discarded food and beverage containers, napkins, straws, plastic eating utensils and the like. The subject invention may also be used in industrial settings which generate lightweight, bulk debris, as well as air borne debris, which accumulates on pipes, air ducts, lights, and overhead fixtures. Additional examples of settings in which the subject invention may be utilized are in wood shops for sawdust and wood turning and shavings, and in patios, walkways, decks, garages, hobby shops, dance halls, skating rinks, movie theaters, restaurants, nightclubs, bars and the like.

The preferred embodiment of the subject invention utilizes a vacuum unit which operates under low static pressure and high CFM, as shown in U.S. Pat. No. 5,722,110incorporated by reference herein. In the preferred embodiment, the blower/vacuum unit is used to pick up large volumes of materials or debris which are deposited directly into the container. The vacuum unit includes an impeller housing, an impeller disposed within the impeller housing, a motor housing attached to the impeller housing and a motor disposed within the motor housing. As described in detail in my co-pending application, the vacuum unit features optional 4 inch and 2 ½ inch hose attachments and accessories to accommodate a wide variety of debris collected from various locations such as around and under stationary objects, tables, chairs, machinery and the like. The various 2 ½ inch wand and hose attachments can accommodate cleaning overhead, such as, by way of example, rafters, pipes, light fixtures, gutters and the like up to twenty-five feet overhead. The vacuum unit includes a powerful one horsepower motor which creates 500 cubic feet of airflow, not static pressure, for cleaning around lights without pulling bulbs from their sockets. Optional voltages of 100, 115, 230 are available for the vacuum unit. The vacuum unit is versatile and may be used on the drum lid assembly of the subject invention or can be easily transformed to a portable cleaner which is mounted as a shoulder carried or a backpack unit or can be easily mounted to a wheel base for mobility. The impact resistant impeller of the vacuum unit withstands contact with lightweight metal objects, such as screws, nuts, aluminum beverage cans and the like. Further, the vacuum unit includes a universal collection bag and a discharge chute. When the vacuum unit is mounted to the lid and utilized with the subject invention, the universal collection bag can be fitted to the discharge chute to provide secondary filtration.

Since the UPKEEPER VOYAGER TURBO TRANSFORMER generates only 10–15 inches of water lift and relies primarily on its 500 CFM of air flow, for collection and cleaning, the collection receptacle can be constructed of a relatively thin wall, light weight, transparent material which can be maneuvered easily. The transparent construction compliments this invention with the ability to provide the operator with a visual determination of the amount of debris or material collected while still operating the equipment. Prior art vacuums require the operator to switch off the equipment and manually open the metal canister to determine if the collection receptacle is full. Further, the thin walled, lightweight, transparent receptacle need not be constructed so as to maintain a virtual airtight seal. Therefore, it can be constructed with flat panel sections to facilitate shipping and storage when not in use.

In the preferred embodiment, the inlet adapter of the inlet connection is uniquely designed to receive a complementary coupling or attachment component which is connected to one end of a selected intake hose for securely attaching the intake hose to the lid. The mechanism for securely attaching the attachment component to the inlet adapter of the blower/vacuum unit may also be included in the attachment between the removable drum lid and accompanying attachment components. The blower/vacuum unit may include a safety switch which must be activated to power the vacuum unit so as to prevent accidental operation prior to the attachment of an intake hose to the inlet connection. When connected to the blower/vacuum unit, the inlet adapter includes means for providing limited access to the safety switch to prevent accidental activation or deactivation of the switch. In order to activate the safety switch, the attachment component must be correctly inserted into the inlet adapter and rotatably snapped into place. When the attachment component is removed, the safety switch breaks the motor controlled circuit and disables the motor.

In the preferred embodiment of the subject invention, the inlet adapter is a substantially cylindrical member with a hollow interior for receiving the attachment component. The inlet adapter includes ridges or blocks extending outward from either side of the member. When connected to the blower/vacuum unit, one of the blocks accepts a cover for the safety switch. A horizontal slot in the side of the block and extending partially into the block allows for limited access to the safety switch for activating the same. The block opposite from the safety switch includes a locking pin for securing the attachment component in place. The locking pin includes a biasing element, such as a spring, for normally urging the locking pin into contact with the attachment component for locking it into place. The attachment component is adapted to be inserted into the inlet adapter for rotatable movement between a disengaged position and an engaging position which snaps the component into place and activates the safety switch and a disengaged position. The attachment component includes a rigid tab which is designed to be inserted into the slot for activating the safety switch. In use, the operator grasps the locking pin and pulls it outward from the inlet adapter. With the locking pin pulled out, the attachment component is inserted into the inlet adapter and rotated so that the tab slides into the side of the block through the horizontal slot. When the tab is inserted into the slot, the tab engages the safety switch to activate it and the component snaps into place. The locking pin is then released so that the pin engages the attachment component and secures it in place.

In the preferred embodiment, the inlet adapter is attached to the inlet connection and has a 4 inch diameter intake for large intake capacity and may be adapted to fit 2 ½ inch diameter cleaning accessories. The collection system of the subject invention may also include an assortment of tools and hose arrangements for allowing a thorough means of vacuuming large industrial areas in a three dimensional fashion. The assortment of tools and hose arrangements may include clear extensions tubes and flexible hoses in 2 ½ and 4 inch diameters and in different lengths, such as 5, 10 and 25 feet. A standard accessory kit may include a 2 ½ inch to 4 inch adapter fitting, 5 extension wands each 20 inches long, an elbow, an elbow dusting brush, a debris tool, a crevice tool, a heavy duty wall/floor tool (14 inches long) and a fabric took caddy.

While the lid is designed to fit snugly on the open top of the container, the subject invention may also include a means for further securing the lid to the container. In the preferred embodiment, the invention may include at least three strap ring assemblies on either side of the lid and at least three bungee-type cords with hooks, extending from either the bottom of the base or walls of the container and hooked to the strap rings on the lid for helping to secure the lid to the container and prevent accidental removal of the lid during use. The base of the subject invention supports the bottom of the container and includes a plurality of wheels for easily maneuvering the container and moving it over a large area as debris is collected. The base is sized to fit the bottom of the container and may be a round dolly, such as, by way of example, a RUBBERMAID (R) dolly. The base may be a rotational, molded, plastic component or constructed of tubular and/or sheet metal and may employ a handle for ease of maneuverability. For example, the base may be a lightweight, plastic dolly, carriage or buggy to snuggly contain the sectional, clear plastic barrel of the preferred embodiment or a standard 55-gallon drum. The base or dolly may also be designed to include a handle and slots or holes for storing spare bags and the various attachments when not in use, and to employ a platform to accommodate a gasoline or propane powered generator.

Therefore, it is an object and feature of the subject invention to provide an easily maneuverable collection apparatus for use with either a blower/vacuum unit for quickly and easily collecting and storing large volumes of bulky debris as it is collected.

It is a further object and feature of the subject invention to provide a collection system for use with a vacuum unit which includes a removable transparent lid having an integral reusable filter and a power unit connection and inlet connection for attaching a vacuum unit and intake hose attachments, an intake hose, a transparent, collapsible container, a transparent, disposable liner and mobile base.

It is another object and feature of the subject invention to provide a novel collapsible container including at least one substantially flat, transparent sheets which are readily assembled into a large container for storing debris collected by an attached vacuum unit.

It is another object and feature of the subject invention to provide a novel transparent lid universally adapted to fit many containers and including a universally adapted inlet adapter and universally adapted power unit connection for attaching either an electrically powered or gasoline or propane powered unit.

It is yet another object and feature of the subject invention to provide a novel inlet adapter for attaching an assortment of hose attachments and tools.

It is a further object and feature of the subject invention to provide an assortment of tools and hose arrangements for attachment to the lid including an flexible hose, an intake chute and a variety of clear wands.

Other objects and features will be readily apparent from the accompanying drawings and description.

DETAILED DESCRIPTION OF THE DRAWINGS

Figure 1:
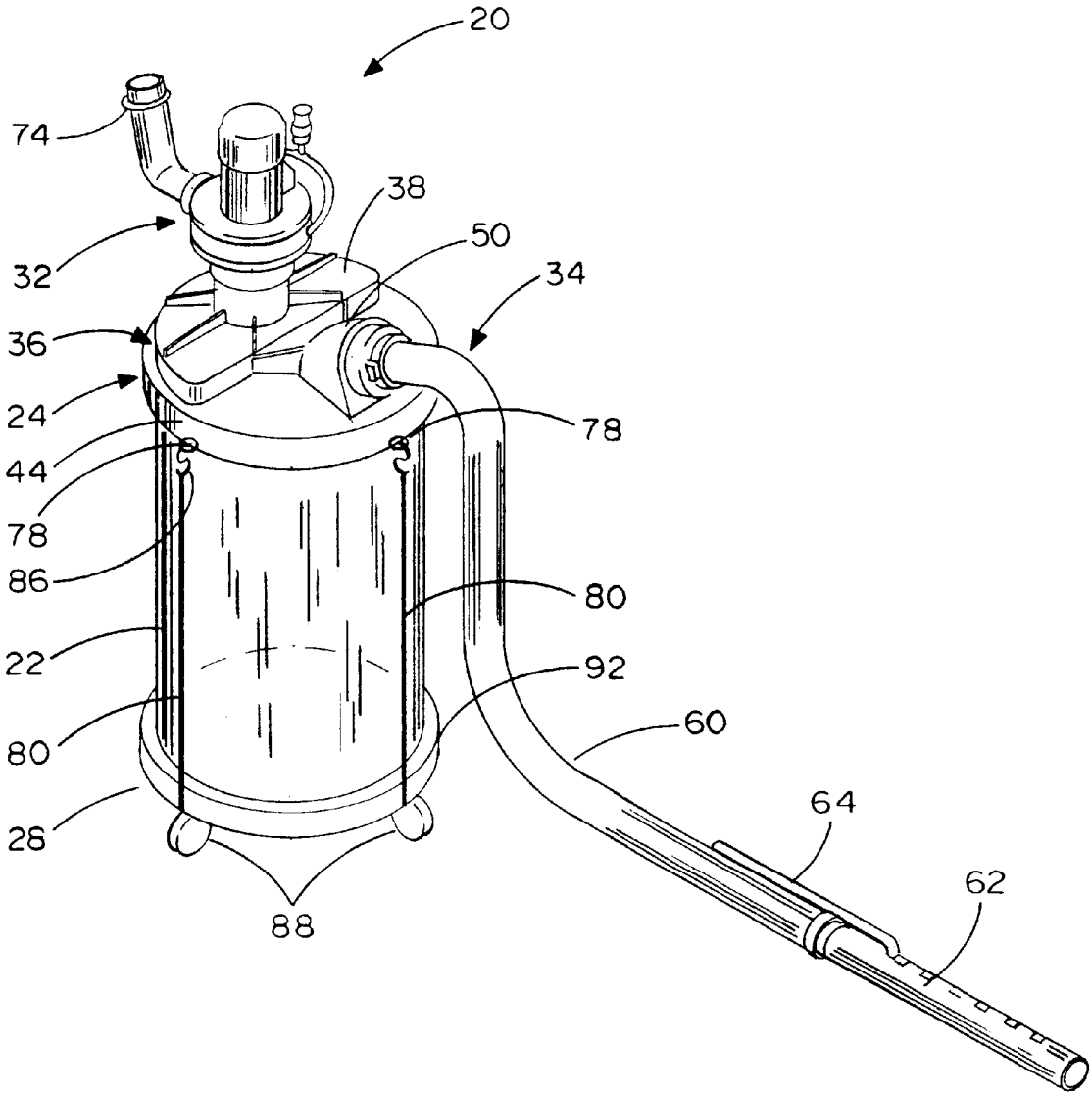
FIG. 1 is a perspective view of the collection apparatus for use with vacuum units showing the apparatus in use collecting debris and utilizing a low static pressure vacuum unit.
Figure 2:
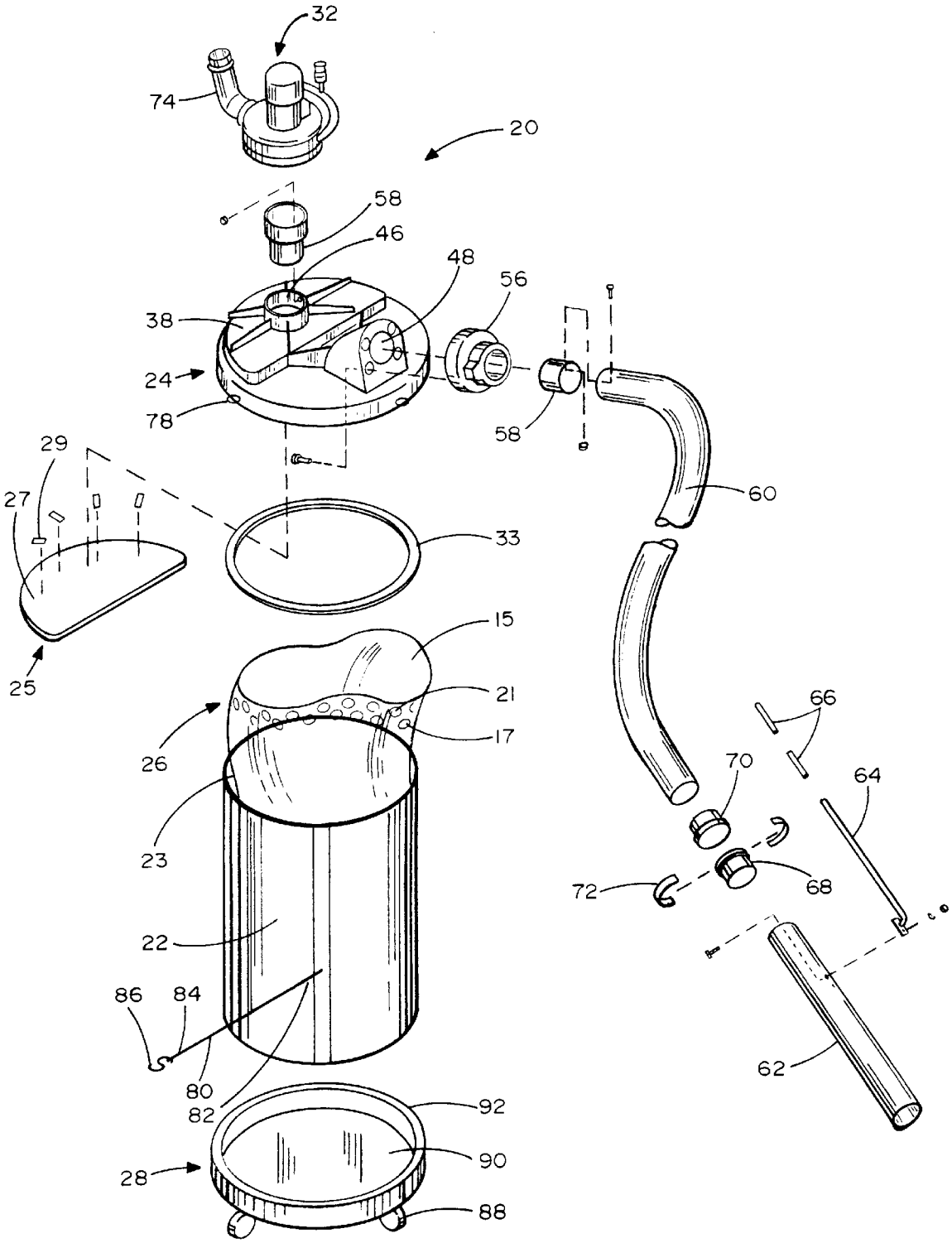
FIG. 2 is an exploded view showing the pieces of the collection apparatus including a removable lid with a reusable filter, a large container, a liner, an intake hose, a base with wheels and a strap ring assembly and corresponding cords for securing the lid in place.

Referring to FIGS. 1–2, the collection apparatus or drum kit of the subject invention for use with blower/vacuum units for easily and quickly collecting and storing large amounts of bulky debris is generally designated by the numeral 20. The collection apparatus 20 includes a large drum or container 22 having an open top 23, a removable lid 24, a disposable and reusable liner 26 and a base 28 for moveably supporting the container 22. The collection apparatus 20 of the subject invention utilizes a blower/vacuum unit, such as vacuum unit 32 and a variety of intake hose attachments, such as intake hose attachment 34, having a large diameter capacity to quickly and easily clean up large volumes of bulky debris while simultaneously depositing the debris into the container 22.

Figure 6:
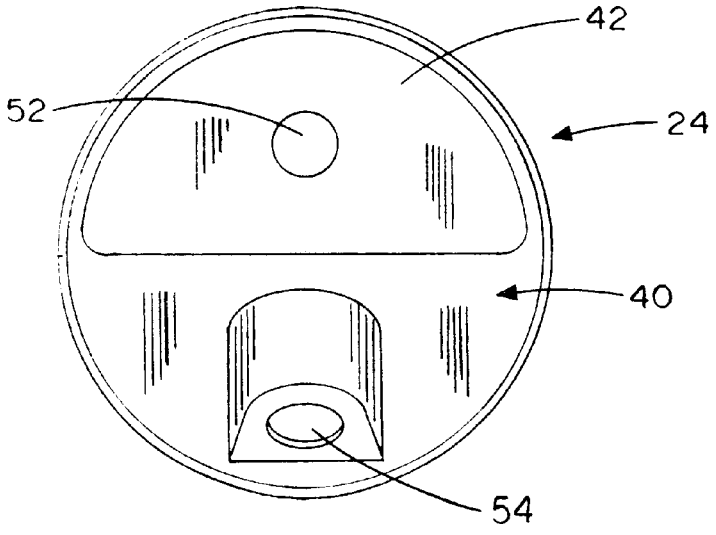
FIG. 6 is a bottom view of the lid showing the through holes and depression for placement of the removable filter.

As shown in FIGS. 2–6, the removable lid 24 of the subject invention includes a top outer side 36 having a raised portion 38 and a bottom underside 40 having a depression 42 formed by the raised portion 38. The lid 24 includes a rim 44 extending downward from the top outer side 36 around the perimeter of the lid 24 for securing the lid to the barrel or container 22. In the preferred embodiment, the lid is molded of a lightweight, transparent, durable material, such as by way of example, a resilient plastic material and is sized to fit over the open top 23 of the container 22. The top outer side 36 includes a first inlet or power unit connection 46 near the center of the raised portion 38 which is adapted to be attached to a blower/vacuum unit, such as vacuum unit 32. The top outer side 36 also includes a second inlet or inlet connection 48, separate from the power unit connection 46, which is adapted for attaching a large diameter intake hose attachment, such as intake hose attachment 34, to the lid 24. As shown in FIGS. 1–5, the inlet connection 48 comprises a raised inlet port 50 which extends above the top outer side 36 of the lid 24. FIG. 6 illustrates the bottom underside 40 of the lid 24 and shows the power unit connection and inlet connection 46, 48 extending through the lid 24 and forming first and second through holes 52, 54 in the bottom underside 40 of the lid 24. The inclusion of the inlet connection 48 on the lid 24 permits the debris to be drawn directly into the container 22 without passing through the power unit connection 46 on which the vacuum unit is mounted. Thus, the debris bypasses the vacuum unit 32 and does not enter the impeller and is deposited directly into the container 22. In the preferred embodiment, the raised inlet port 50 of the inlet connection 48 is designed to include an inlet adapter 56 which is universally adapted to fit different intake hose accessories having a variety of hose sizes for carrying debris into the container 22. In the preferred embodiment, universal couplings or attachment components 58 may be included for quickly and easily securing a blower/vacuum unit to the power unit connection 46 and for quickly and easily securing a variety of intake hose attachments to the inlet connection 48. The attachment component 58 is adapted to be received by the inlet adapter 56 and may be connected to one end of the intake hose attachment 34 for securely attaching the intake hose attachment 34 to the lid 24. In addition, the attachment component 58 may be connected to the power unit connection 46 and is adapted to be attached to the vacuum unit 32 for mounting the vacuum unit to the lid 24.

Figure 3:
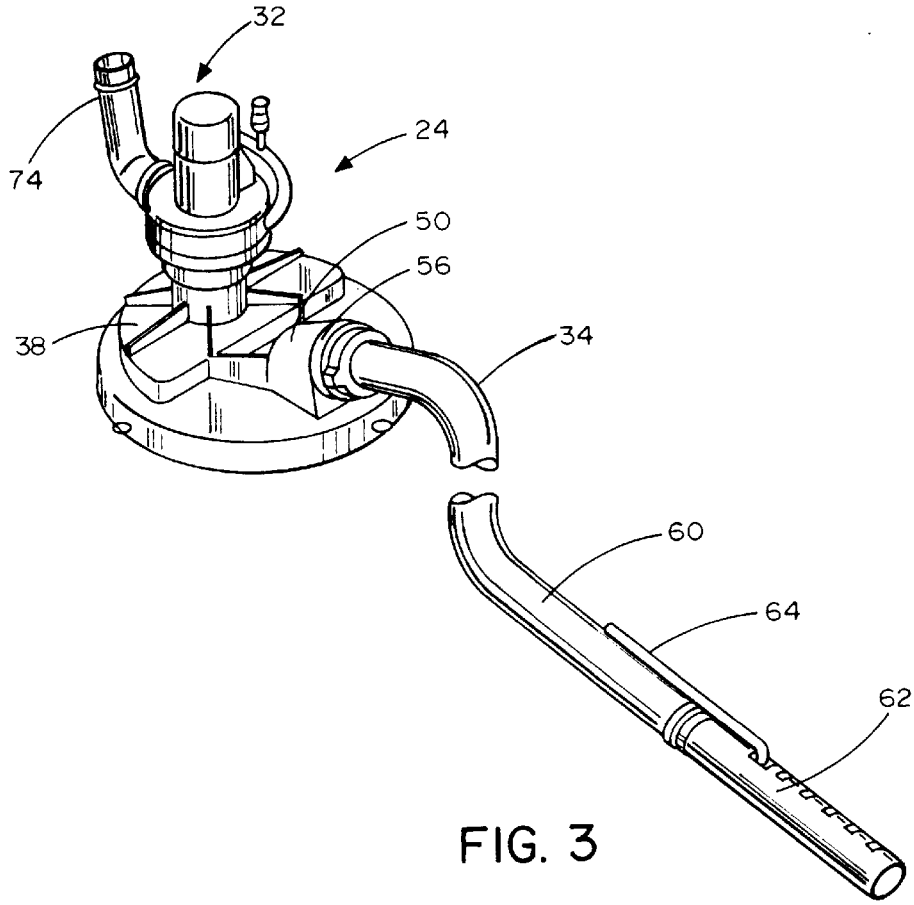
FIG. 3 is a perspective view of the removable lid having a first and second inlet and a vacuum unit and intake hose attached to the inlets, respectively.

The inlet adapter 56 of the preferred embodiment has a 4 inch diameter intake for large intake capacity and may be adapted to fit 2 ½ inch diameter cleaning accessories. The collection apparatus 20 of the subject invention may also include an assortment of tools and hose arrangements for allowing a thorough means of vacuuming large industrial areas in a three dimensional fashion. The assortment of tools and hose arrangements may include clear extensions tubes and flexible hoses in 2 ½ and 4 inch diameters and in different lengths, such as 5, 10 and 25 feet. A standard accessory kit may include a 2 ½ inch to 4 inch adapter fitting, extension wands each 20 inches long, an elbow, an elbow dusting brush, a debris tool, a crevice tool, a heavy duty wall/floor tool (14 inches long) and a fabric took caddy. As shown in FIGS. 1–3, the intake hose attachment 34 may be a flexible hose 60 which is attached to an intake chute 62 having a handle 64 with a foam grip 66. The intake chute 62 is attached to the flexible hose using a pair of couplings 68, a swivel 70 and a collar 72.

Figure 4:
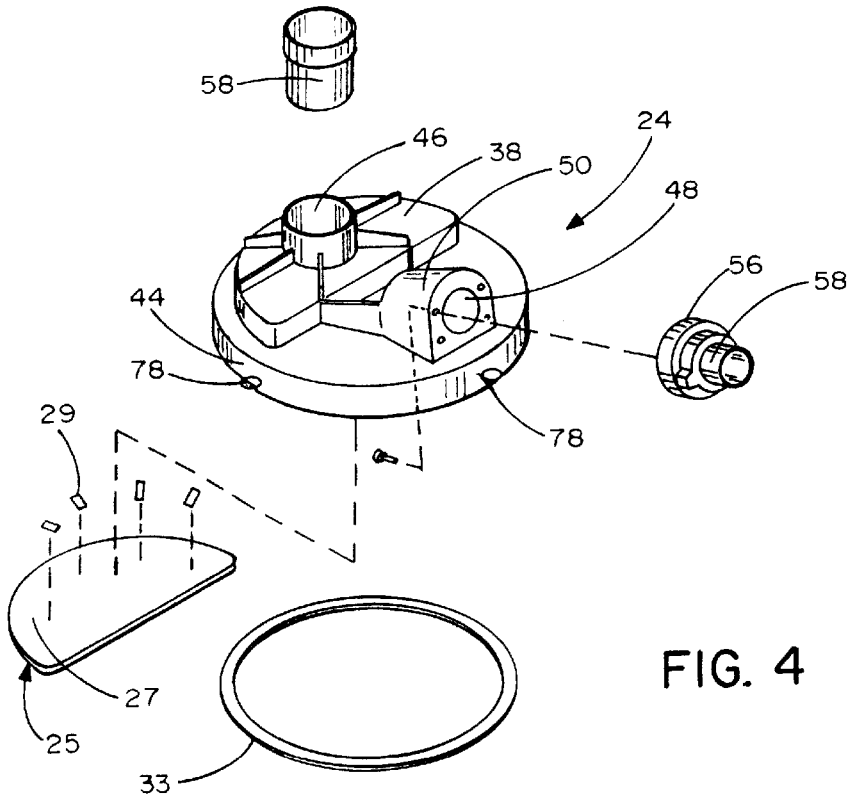
FIG. 4 is an exploded view showing the elements of the lid including a coupling for attachment to the power unit connection and an inlet adapter for attachment to the inlet connection, and a removable filter and foam stripping for attachment to the underside of the lid.
Figure 5:
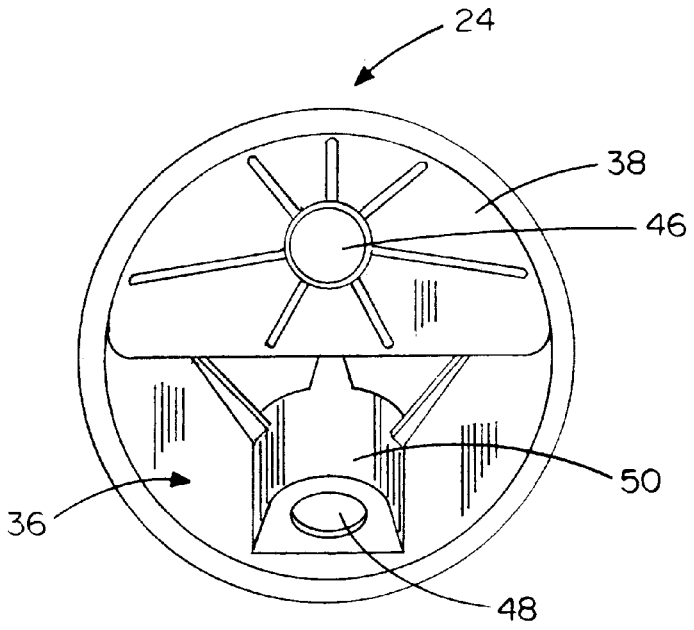
FIG. 5 is a top view of the lid showing the raised portion and the location of the power unit connection power unit connection and inlet connection.

As shown in FIGS. 2 and 4, the removable lid 24 includes an integral filter 25 which serves as an air-cleansing medium to contain small air borne dust and dirt particulates from discharging freely into the atmosphere. The integral filter 25 is located in the indented portion or depression 42 so that it is positioned between the power unit connection 46 and the interior of the container 22 for filtering air drawn through the first inlet by the blower/vacuum unit attached to the power unit connection 46. In the preferred embodiment, the filter 25 is removably attached to the underside of the lid and includes a hook and loop type fastener 27 with complementary mated fastener strips 29, such as with VELCRO (R), for easily and quickly removing the filter 25 and reattaching the same. The filter 25 can be cleaned simply by detaching it from the Velcro (R) strips 29, without requiring the use of tools, and shaking it vigorously, using a compressed air hose or by rinsing it. The lid 24 of the preferred embodiment may also include a foam or rubber stripping 33 along the interior of the rim 44 for securing the lid to the container 22 (see FIG. 2). The foam stripping 33 provides an air seal between the lid and the container which increases air intake and cleaning efficiency at the collection point of the cleaning accessories.

Figure 13:
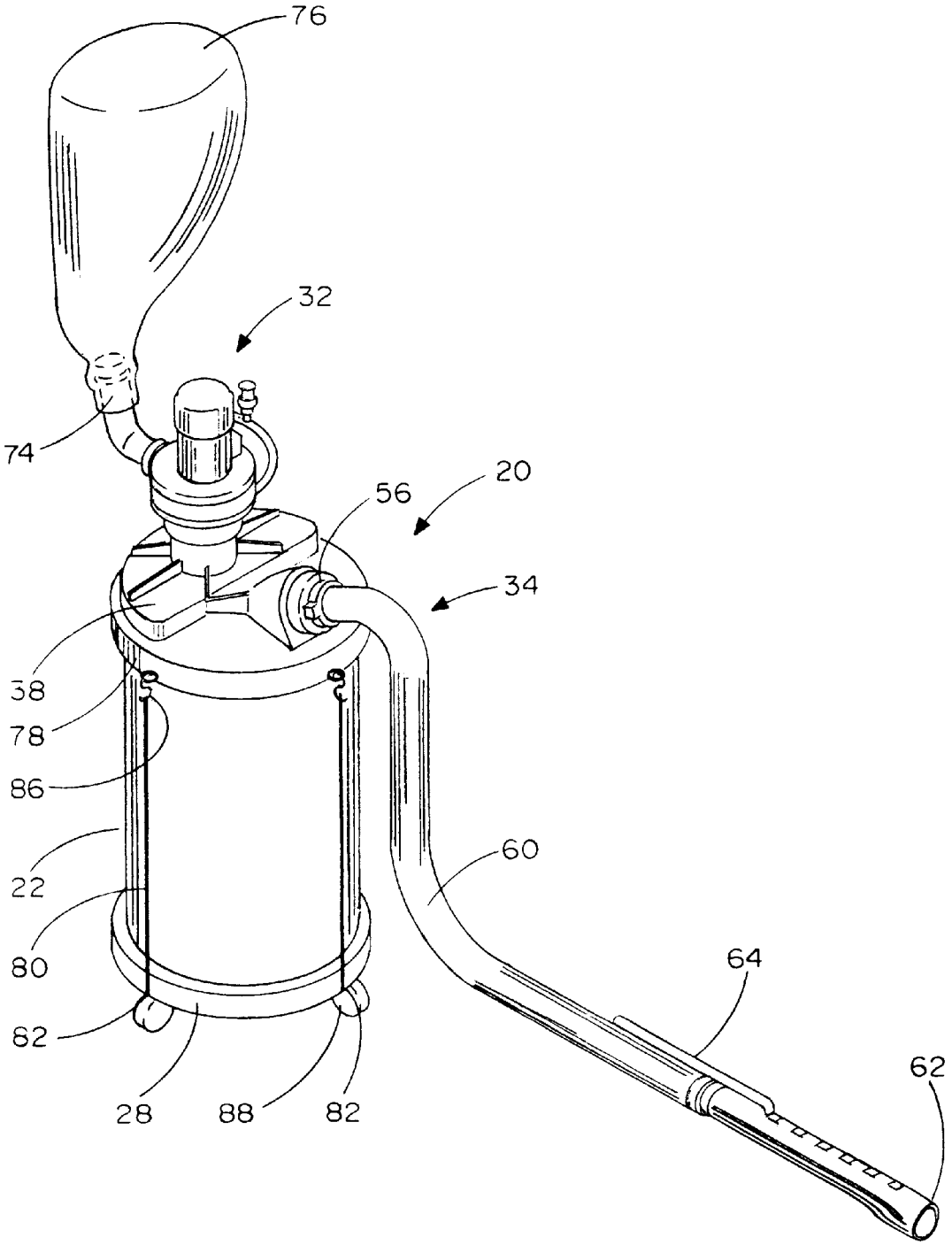
FIG. 13 is a perspective view of a second filter to provide the collection apparatus with a double filtration feature.

In the preferred embodiment, the subject invention utilizes a vacuum unit 32 which operates under low static pressure and high CFM, as shown in U.S. Pat. No. 5,722,110 incorporated by reference herein. The preferred vacuum unit 32 includes an impeller housing, an impeller disposed within the impeller housing, a motor housing attached to the impeller housing, a motor disposed within the motor housing and a discharge chute 74. The vacuum unit includes a powerful one horsepower motor which creates 500 cubic feet of airflow, not any appreciable static pressure, and optional voltages of 100, 115, 230 are available for the vacuum unit. The vacuum unit is versatile and may be mounted on the removable lid 24 of the subject invention or can be easily transformed to a portable cleaner which is mounted as a shoulder or a backpack unit or can be easily mounted to a wheel base for mobility as shown in U.S. Pat. No. 5,722,110. When the vacuum unit is mounted to the lid 24 and utilized with the subject invention, a second collection bag 76, such as the universal collection bag shown therein and available with most state of the art vacuum/blowers, can be fitted to the discharge chute 74 to provide secondary filtration (see FIG. 13). While the preferred vacuum unit 32 is illustrated herein, it will be understood that a variety of electrically or fuel powered vacuum and blower units may be used in connection with the subject invention.

It is a feature of the subject invention that a standard drum, such as by way of example, a 55 gallon drum or another large receptacle or container having an open top, may be utilized with the subject invention and that the removable lid 24 may be custom molded to securely fit and cover the open top of the selected container. In the preferred embodiment, the container 22 is a collapsible, lightweight, transparent container comprised of one or more substantially flat sheets or panels 35 which may be readily assembled to form the container having a hollow interior 37, open top 23 and open bottom 39 and may be readily disassembled to conveniently store and ship the container. Referring to FIGS. 7–12, the collection apparatus 20 of the subject invention includes three embodiments of the preferred collapsible container 22 each having a different means for connecting the panels to one another to form the collapsible container 22. While three embodiments are shown, it will be understood that the invention is directed to the use of multiple panels to form a collapsible, transparent, lightweight container for use with blower/vacuum units and any suitable means for connecting the panels together to form the collapsible container may be utilized. In each embodiment, the panels 35 have opposite side ends 41, 43 and are a sturdy, lightweight, semi-flexible or resilient plastic material. The preferred panels 35 are transparent for permitting the operator to easily monitor the remaining capacity of the collapsible container 22 while it is in use. The clear, plastic panels 35 comprising the container 22 are approximately 0.100 inches thick and approximately 28"×34" so as to form a 24" internal diameter when joined and forming the cylindrical container 22. While two panels 35 are illustrated, it will be understood that one or more panels may be utilized as desired to form the collapsible container 22. In each embodiment, the panels include top and bottom ends 100, 102 each having a rim 104 and may include a top and bottom sponge or rubber type air seal member 106 adapted to be fitted onto the top and bottom rims of the cylindrical container (See FIG. 11).

Figure 7:
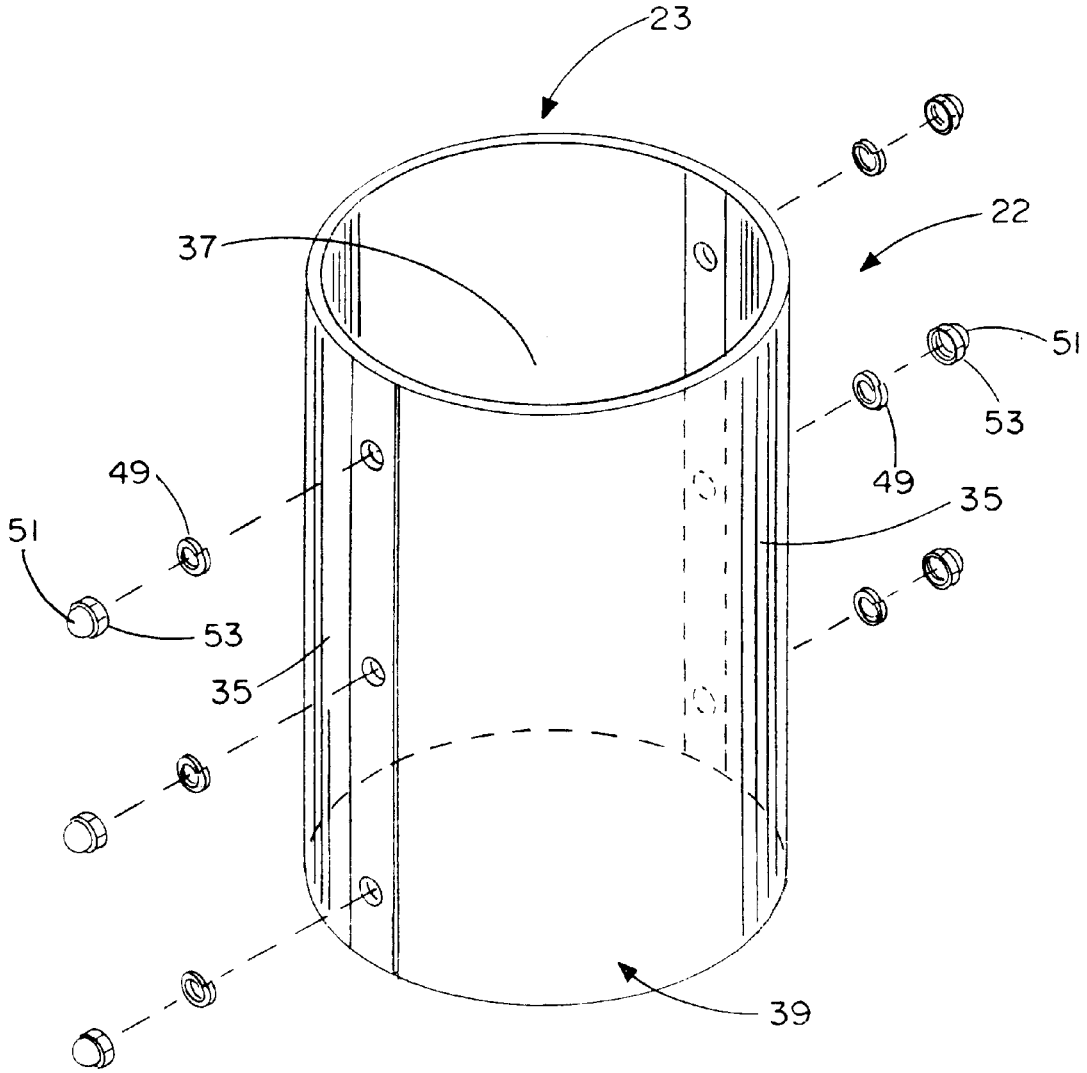
FIG. 7 is a perspective view of the transparent collapsible container of the collection apparatus showing the panels assembled together using hardware.
Figure 8:
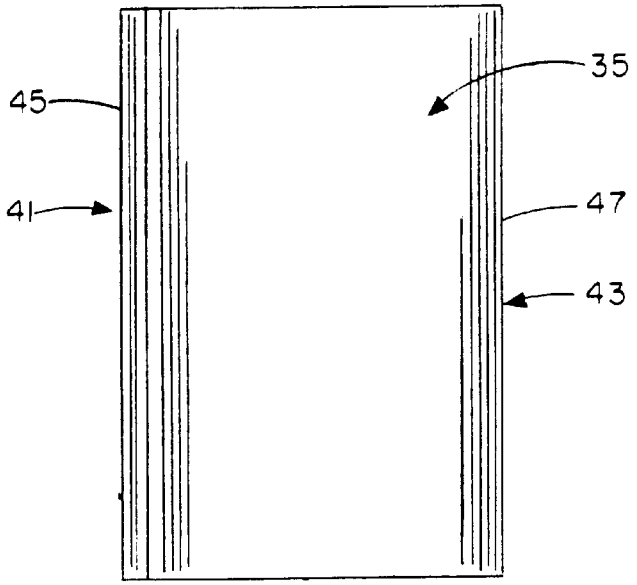
FIG. 8 is a view of one of the disassembled, flat panels which form the container of the collection apparatus.
Figure 9:
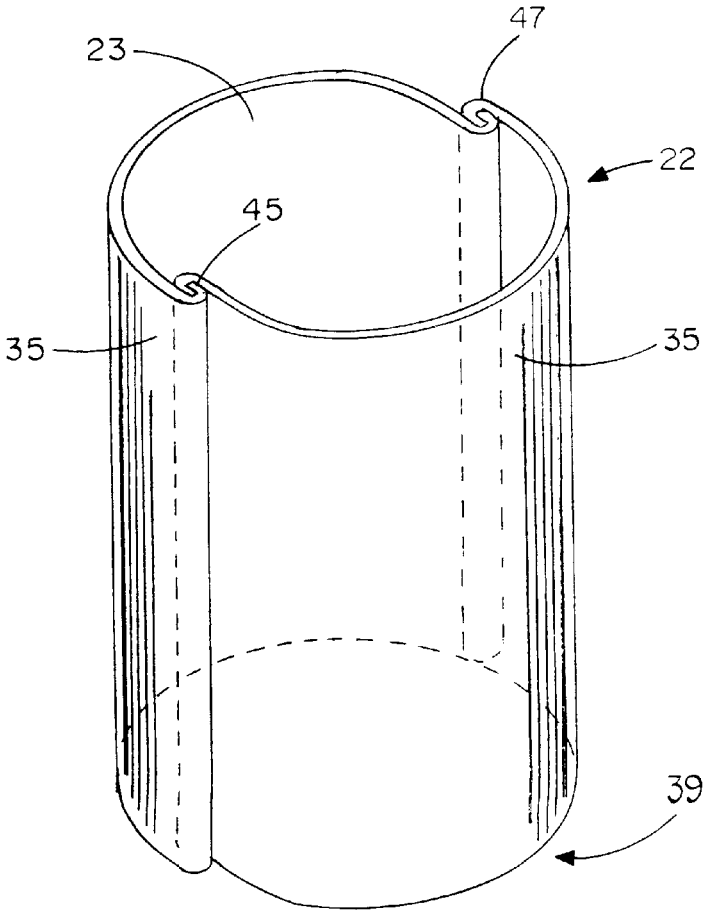
FIG. 9 is a perspective view of the transparent collapsible container of the collection apparatus with interlocking panels assembled together to form a cylindrical container.
Figure 10:
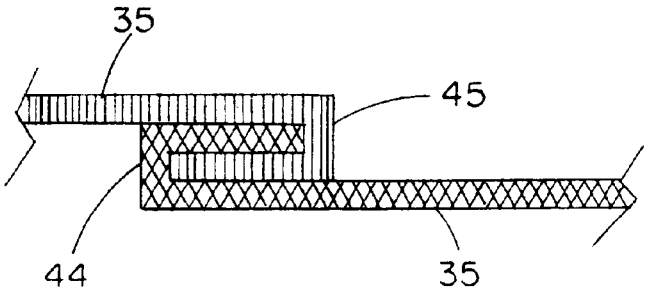
FIG. 10 is an enlarged top view of the interlocking members of the panels forming the container.
Figure 12A:
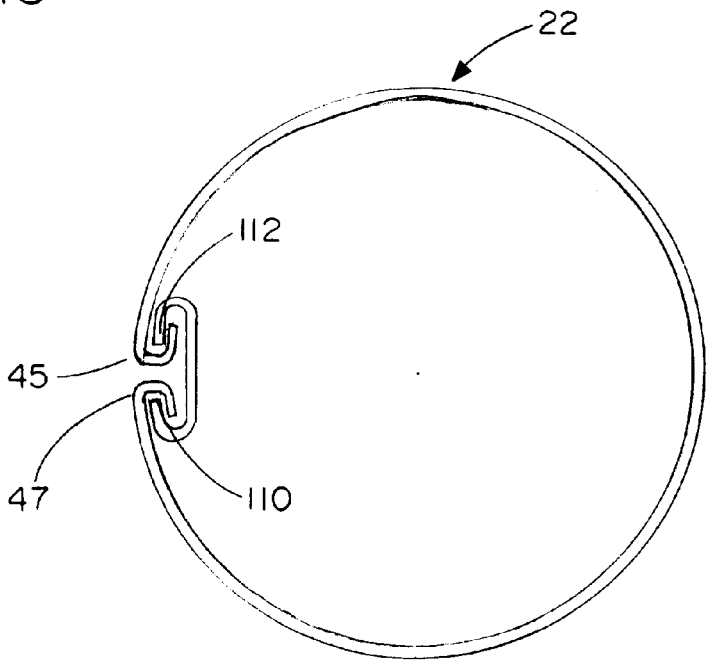
FIG. 12A is an enlarged top view of the container showing the panel formed into the cylindrical container and secured with a C-shaped connector strip.
Figure 12:
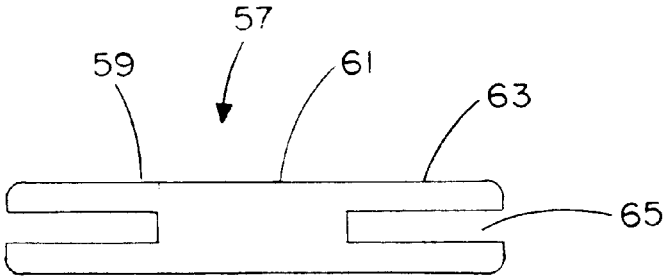
FIG. 12 is an enlarged top view of a connector strip member to be attached to the panels for securing the panels together to form the container.
Figure 11:
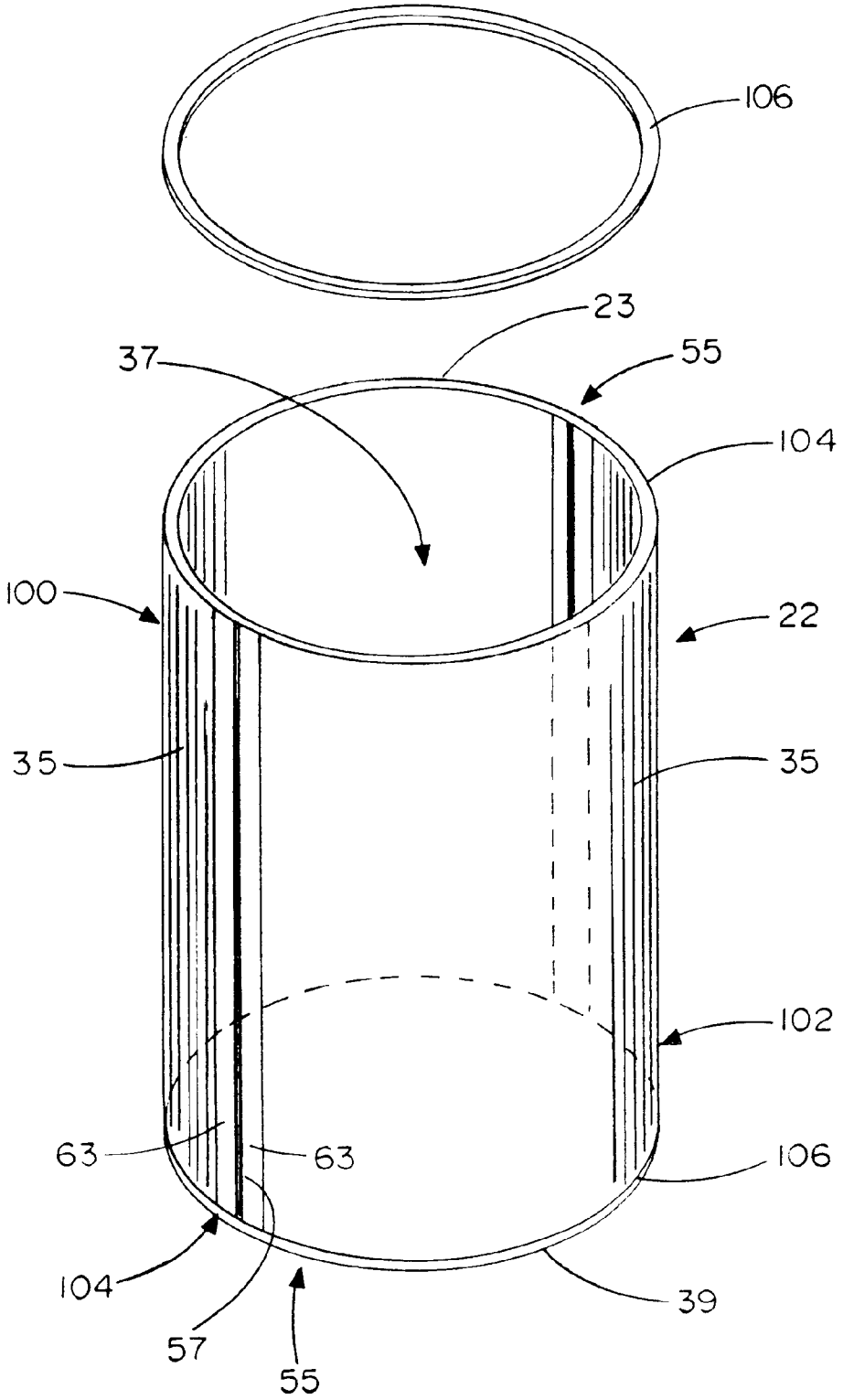
FIG. 11 is a perspective view of the transparent collapsible container of the collection apparatus showing the panels assembled together using a connector strip.

In the first embodiment of the collapsible container 22, the panels 35 are assembled into the collapsible container 22 using hardware to secure the panels together to for the cylindrically shaped container 22. The panel sides 41, 43 include panel edges 45, 47 with one panel side 41 having a double layer of material at the panel edge 45 to form a pocket for receiving the panel edge 47 of the adjacent panel 35 (see FIG. 8). As shown in FIG. 7, the panel edges 45, 47 are then secured to each other utilizing washers 49, screws 51, nuts 53 and/or push-through fasteners which penetrate the panel edges 45, 47 and secure the panels 35 together to form the cylindrically shaped barrel or container 22. In the second embodiment shown in FIG. 9, the panels 35 of the collapsible barrel are custom molded to interlock with one another using no hardware to form the cylindrical container 35. As best seen in FIG. 10, the panel edges 45, 47 of the second embodiment include a hook-shaped end for hooking onto the adjacent panel edge 45 or 47 and securing the panels 35 to form the cylindrically shaped container 22. In a third embodiment, the panels 35 have flat edges 45, 47 and are assembled into the collapsible barrel 22 by attaching a plastic or metal connector strip 55 between the panel edges 45, 47 of two adjacent panels 35 (see FIG. 11). As shown in FIG. 12, the connector strip 55 includes an "H" shaped member 57 having opposite sides 59, 61 and a holder 63 extending from each side 59, 61 of the member 57 having a slot 65 which is adapted to receive the panel edges 45, 47 of two adjacent panels 35. The panel edges 45, 47 are approximately ⅛ inch thick and fit snugly within the slot 65. Each holder 63 includes a taper in the slot 65 for securely holding the panel edges 45, 47 therein. In the fourth embodiment, the container is constructed using a single panel having C-shaped end. The C-shaped ends engage a connector strip 108 having opposite ends 110, 112. As shown in FIG. 12A, the connector strip 108 fits over the C-shaped panel edges 45, 47 to secure the panel in the shape of a cylindrical container. While the preferred container is a collapsible, multi-piece drum, it will be understood that most large containers may be used with the subject invention, including, but not limited to, a standard 55 gallon drum, a cardboard or plastic container and the like.

The collapsible container 22 includes the transparent disposable bag or liner 26 having an open top end 15, side walls 17 and a closed bottom end for receiving and storing the debris deposited into the container 22. When the liner 26 is full, the removable lid 24 is removed and the liner 26 is easily lifted from the container and emptied for reusing the liner or simply disposed by the operator. The preferred liner 26 includes a plurality of through or vent holes 21 near the open top end 15 to provide an air path through which air entering the container may escape for preventing the liner 26 from collapsing. The vent holes 21 are located in the top one third of the liner 26 while the bottom two-thirds of the bag is sealed for preventing leaking or spills as the bag is lifted and removed from the container 22. In the preferred embodiment, the liner 26 is an internal plastic disposable bag which is utilized under the low static pressure and high CFM condition.

While the removable lid 24 is designed to fit snugly on the open top of the container 22, the subject invention may also include a means for further securing the lid 24 to the container. In the preferred embodiment, the invention includes at least three strap ring assemblies 78 spaced along and secured to the rim 44 of the lid 24 and at least three bungee-type cords 80 having opposite ends 82, 84 with one end 82 secured to the base 28 or the wall of the container and the other end 84 including a hook 86 (see FIGS. 1–2). In use, the cords 80 extend upward from the base or wall of the container and the hook 86 is hooked to the strap rings 78 on the lid 24 for helping to secure the lid to the container 22 and prevent accidental removal of the lid 24 during use.

Figure 15:
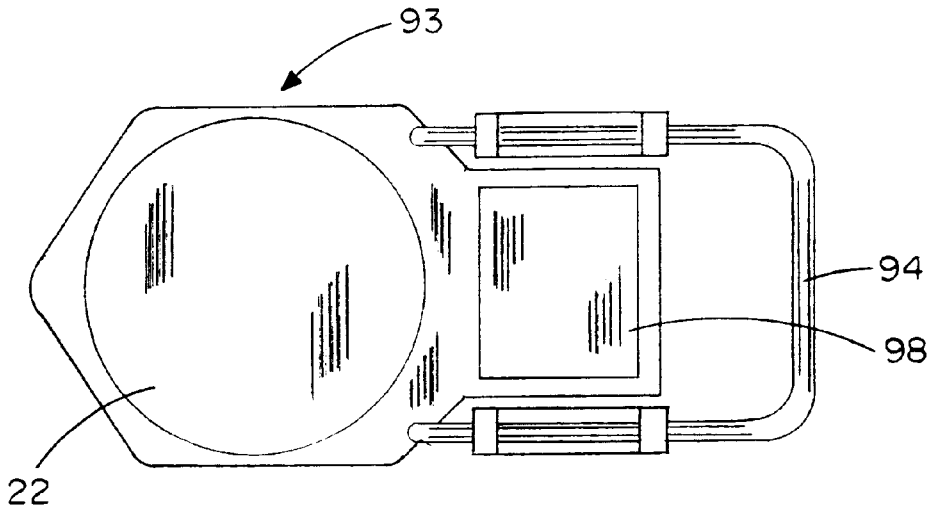
FIG. 15 is a top view of the base illustrated in FIG. 14.
Figure 14:
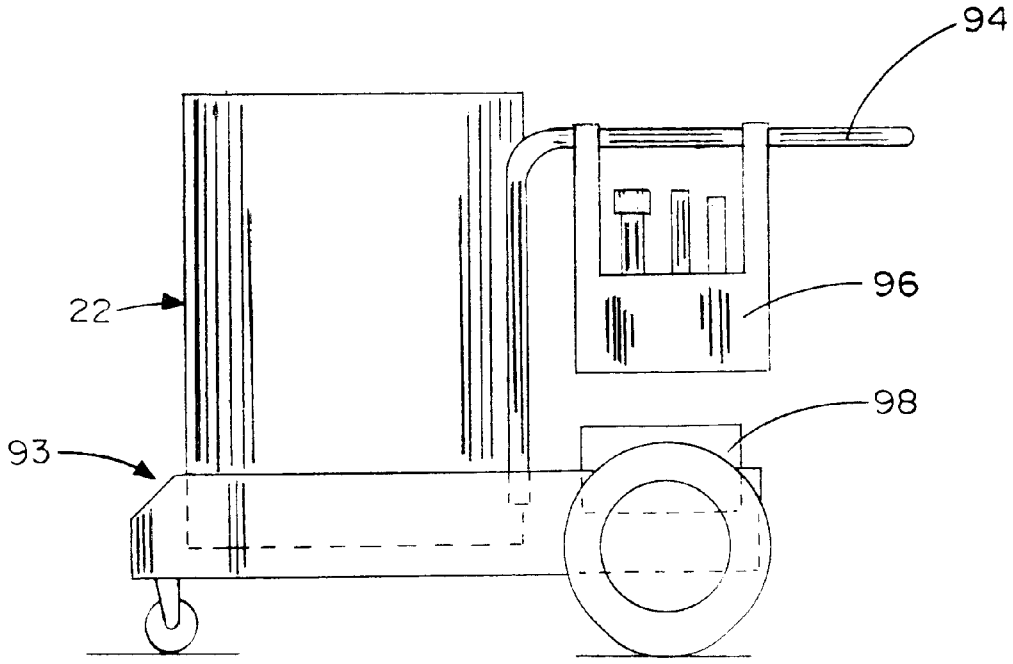
FIG. 14 is a side view of a base to accommodate the collapsible container, storage of spare bags and various attachments and shows a platform for placement of a gasoline or propane powered generator.

As shown in FIGS. 1–2, the base 28 of the subject invention supports the bottom of the container 22 and includes a plurality of wheels 88 for easily maneuvering the container. In the preferred embodiment, the base 28 includes a closed bottom 90 and an upstanding sidewall 92 and is sized to fit and forms the bottom of the collapsible container 22. The base 28 is sized to fit the bottom of the container and may be a round dolly, such as, by way of example, a RUBBERMAID 55 gallon drum dolly or the like, and is designed to snuggly contain the sectional, clear plastic barrel or container 22 of the preferred embodiment or a standard 55-gallon drum. In an alternative embodiment, the base may also be a rotational molded plastic component 93 or constructed of tubular and/or sheet metal and may employ a handle 94 for pushing the container and for ease of maneuverability. As shown in FIGS. 14 and 15, it may also be designed so as to included slots or holes or a storage bag 96 for storing spare bags and the various attachments when not in use and employ a platform 98 to accommodate a gasoline or propane powered generator.

While specific embodiments and features of the invention have been disclosed herein, it will be readily understood that the invention encompasses all enhancements and modifications within the scope and spirit of the following claims.

What is claimed is:

1. A collection apparatus for collecting and storing large amounts of bulky materials or debris, said apparatus comprising:

a. a large container having an open top, a bottom and a hollow interior for storage of debris;

b. a removable lid adapted to securely fit and cover the open top of the container, said lid having a top outer side, and a bottom underside, said top outer side including a raised portion, and said bottom underside including a depression formed by the raised portion, said lid having an integral filter adapted to fit in the depression and being selectively and removably attached therein, and including a power unit connection adapted for removably attaching a blower/vacuum unit to the lid and an inlet connection adapted for removably attaching a variety of different intake hose attachments to the lid and receiving debris into said container; and c. a base for supporting the bottom of the container.

2. The collection apparatus of claim 1, wherein said container is a standard-size drum.

3. The collection apparatus of claim 1, further comprising a disposable or reusable liner having an open top end and being adapted to fit inside said container for lining said container and collecting debris therein.

4. The collection apparatus of claim 1 wherein said lid is transparent.

5. The collection apparatus of claim 1, wherein said filter is positioned between said power unit connection and the interior of the container for filtering the air drawn through the power unit connection by the vacuum unit.

6. The collection apparatus of claim 5, wherein said inlet connection is positioned separate from said power unit connection whereby debris enters said container directly without passing through said power unit connection.

7. The collection apparatus of claim 1, said base further comprising a plurality of rollers for easily and rotationally maneuvering said container over a large area.

8. The collection apparatus of claim 7, wherein said base further includes a platform attached to the base for carrying a gasoline or propane powered generator.

9. The collapsible container of claim 7, wherein said base includes a handle for pushing and maneuvering said base.

10. The collection apparatus of claim 1, further comprising means attached to said container and to said lid for securing said lid to said container.

11. The collection apparatus of claim 1, said lid further comprising a rim and a foam stripping along the interior of said rim for securing said lid to a container and providing an air seal between the lid and the container.

12. The collection apparatus of claim 1, further comprising an electrically powered vacuum unit adapted to be attached to said power unit connection.

13. The collection apparatus of claim 1, further comprising a fuel powered vacuum unit adapted to be attached to said power unit connection.

14. A collection apparatus for collecting and storing large amounts of bulky materials or debris, said apparatus comprising:

a. a large container having an open top, a bottom and a hollow interior for storage of debris;

b. a removable lid adapted to securely fit and cover the open top of the container, said lid having an integral filter and including a power unit connection adapted for removably attaching a blower/vacuum unit to the lid and an inlet connection adapted for removably attaching a variety of different intake hose attachments to the lid and receiving debris into said container; and c. a base for supporting the bottom of the container;

said container further comprising one or more substantially flat panels having opposite side ends, said panels adapted to be secured to one another to form a collapsible container having a hollow interior, an open top and an open bottom.

15. The collection apparatus of claim 14, said panels further comprising a means for connecting said panel side ends to each other to form the collapsible container.

16. The collection apparatus of claim 15, wherein said container is mounted on said base and said base defines a closed bottom of said container.

17. The collection apparatus of claim 15, wherein said panels are a sturdy, lightweight, resilient plastic.

18. The collection apparatus of claim 17, wherein said panels are transparent.

19. The collection apparatus of claim 14, further comprising a disposable or reusable liner having an open top end and being adapted to fit inside said container for lining said container and collecting debris therein, wherein said liner includes a plurality of through holes near the open top end for providing ventilation and preventing the liner from collapsing as air is drawn into the vacuum unit.

20. The collection apparatus of claim 19, wherein said liner is a transparent plastic bag.

21. The collection apparatus of claim 14, said lid further comprising a top outer side and a bottom underside and said integral filter selectively and removably secured to said underside of the lid, wherein said lid includes a hook and loop type fastener with complementary mated fastener strips on the lid and said filter, respectively for selectively and removably securing said filter to said underside of said lid.

22. The collection apparatus of claim 14, said power unit connection further comprising a universal coupling for attaching a vacuum unit to the lid.

23. The collection apparatus of claim 14, further comprising at least one intake hose attachment adapted to be attached to the inlet connection in the lid for collecting debris.

24. The collection apparatus of claim 23, said inlet connection further comprising a universal inlet adapter for quickly and easily attaching said intake hose attachment to said lid and for receiving bulky debris into said container.

25. The collection apparatus of claim 24, further comprising an intake hose having an attachment component, said attachment component being adapted to be received by said inlet adapter.

26. The collection apparatus of claim 23, said intake hose attachment further comprising a flexible input hose.

27. The collection apparatus of claim 14, further comprising means attached to said base and to said lid for securing said lid to said container.

28. The collection apparatus of claim 27, wherein said means is a hook and ring assembly and a flexible cord for securing the lid in place.

29. A lid for use with blower/vacuum units for covering an open top of a large container, said lid comprising:

a. a top outer side and a bottom underside, said top outer side including a raised portion;

b. a power unit connection in the top outer side near the center of the raised portion, said power unit connection extending through and forming a first through hole in the bottom underside of the lid and being adapted to be attached to a vacuum unit or a blower unit;

c. an inlet connection in the top outer side including a raised inlet port extending through and forming a second through hole in the bottom underside of the lid and being adapted for large diameter intake capability for receiving vacuumed debris, d. a depression on the bottom underside of the lid formed by the raised portion; and e. a filter adapted to fit in the depression and being selectively and removably attached therein.

30. The lid of claim 29, wherein said depression and said filter includes a hook and loop type fastener with complementary mated fastener strips for selectively and removably securing said filter to said bottom underside of said lid.

31. The lid of claim 29, wherein said filter is positioned across the first through hole for filtering the air drawn through the power unit connection by the vacuum unit.

32. The lid of claim 29, said power unit connection further comprising a coupling having a first end adapted to be attached to said power unit connection and a second end adapted for attachment to a vacuum unit.

33. The lid of claim 29, said inlet connection further comprising a raised inlet port extending above said top outer side of the lid.

34. The lid of claim 29, said inlet connection further comprising an inlet adapter adapted to be secured to said raised inlet port for attaching a collection hose to said lid for collecting debris.

35. The lid of claim 34, further comprising an intake hose having an attachment component, said attachment component being adapted to be received by said inlet adapter.

36. The lid of claim 34, wherein said lid is formed of a durable lightweight, plastic material.

37. The lid of claim 29, further comprising a rim for securing said lid to an open top of a container.

38. The lid of claim 37, further comprising a foam stripping along the interior of said rim for securing said lid to a container.

39. The lid of claim 37, said rim further comprising a means for further securing said lid to a container.

40. The lid of claim 39, wherein said means is a hook and ring assembly and a flexible cord for securing the lid in place.

* * * * *